US008104386B2

(12) United States Patent
Chen

(10) Patent No.: US 8,104,386 B2
(45) Date of Patent: Jan. 31, 2012

(54) QUICK RELEASE DEVICE FOR SAW BLADE GUARD ASSEMBLY IN A CIRCULAR SAW AND SAW BLADE GUARD ASSEMBLY USING THE SAME

(75) Inventor: Jung-Huo Chen, Taichung Hsien (TW)

(73) Assignee: Rexon Industrial Corporation Ltd. (TW)

( * ) Notice: Subject to any disclaimer, the term of this patent is extended or adjusted under 35 U.S.C. 154(b) by 664 days.

(21) Appl. No.: 12/213,720

(22) Filed: Jun. 24, 2008

(65) Prior Publication Data

US 2009/0025523 A1 Jan. 29, 2009

(30) Foreign Application Priority Data

Jul. 26, 2007 (TW) ..... 96127346 A

(51) Int. Cl.
*B27G 19/08* (2006.01)

(52) U.S. Cl. ..... 83/102.1; 83/477.2; 83/478

(58) Field of Classification Search ..... 83/477.2, 83/478, 102.1, 860, 698.11, 650; 144/253.6, 144/251.1, 251.3
See application file for complete search history.

(56) References Cited

U.S. PATENT DOCUMENTS

| | | | | |
|---|---|---|---|---|
| 4,572,047 | A * | 2/1986 | Punater et al. | 83/481 |
| 5,322,302 | A * | 6/1994 | Quirijnen | 279/22 |
| 5,410,933 | A * | 5/1995 | Miyamoto et al. | 83/783 |
| 5,573,255 | A * | 11/1996 | Salpaka | 279/75 |
| 6,256,889 | B1 * | 7/2001 | Zuro | 30/339 |
| 6,840,144 | B2 * | 1/2005 | Huang | 83/102.1 |
| 7,003,888 | B2 * | 2/2006 | Bigden et al. | 30/392 |
| 7,210,386 | B1 | 5/2007 | Chang | |
| 7,302,878 | B2 | 12/2007 | Chang | |
| 7,546,792 | B2 * | 6/2009 | Liu et al. | 83/478 |
| 7,631,585 | B2 * | 12/2009 | Ichikawa et al. | 83/102.1 |
| 7,665,393 | B2 * | 2/2010 | O'Banion et al. | 83/102.1 |
| 2005/0211034 | A1 | 9/2005 | Sasaki et al. | |
| 2007/0000366 | A1 | 1/2007 | Peot et al. | |
| 2007/0056416 | A1 | 3/2007 | Shibata | |
| 2007/0113714 | A1 | 5/2007 | Burke et al. | |
| 2007/0113715 | A1 | 5/2007 | Burke et al. | |
| 2007/0163408 | A1 | 7/2007 | Buck et al. | |
| 2007/0186739 | A1 | 8/2007 | Peot et al. | |
| 2007/0186741 | A1 | 8/2007 | Buck et al. | |
| 2007/0277661 | A1 | 12/2007 | Domeny et al. | |
| 2008/0022826 | A1 | 1/2008 | Weir et al. | |
| 2008/0022827 | A1 | 1/2008 | Weir et al. | |
| 2008/0047409 | A1 | 2/2008 | Chuang | |
| 2009/0056514 | A1 * | 3/2009 | Chen | 83/102.1 |
| 2010/0101388 | A1 * | 4/2010 | Chen | 83/102.1 |

FOREIGN PATENT DOCUMENTS

TW M328333 3/2008

* cited by examiner

*Primary Examiner* — Boyer D Ashley
*Assistant Examiner* — Omar Flores Sanchez
(74) *Attorney, Agent, or Firm* — Bacon & Thomas, PLLC

(57) ABSTRACT

A quick release device for a saw blade guard assembly in a circular saw includes a mounting block having two spaced sidewalls, a mounting groove defined between the two sidewalls for receiving a spreader, and two through holes respectively defined through the sidewalls and in communication with the mounting groove and a locating hole. At least one movable engagement member is movably disposed in the through hole of the mounting block. A locking member having two spaced locking blocks mounts onto the mounting block. Each of the locking blocks has a retaining wall portion for engaging the at least one movable engagement member and forcing the at least one movable engagement member to be held in the locating hole of the spreader.

18 Claims, 6 Drawing Sheets

QUICK RELEASE DEVICE FOR SAW BLADE GUARD ASSEMBLY IN A CIRCULAR SAW AND SAW BLADE GUARD ASSEMBLY USING THE SAME

BACKGROUND

1. Field of the Invention

The present invention relates to circular saws and more particularly, to a quick release device for a saw blade guard assembly in a circular saw and a saw blade guard assembly using the same.

2. Description of the Related Art

Each of U.S. Patent Application Publication Nos. 2007/0113714 and 2007/0113715 disclose a module guard system for use in a power sawing machine, and the module guard system includes a spreader and a quick release device.

According to the '714 publication, the quick release device includes a support member, a locking block, and two bolts. The locking block has a mounting groove formed at a bottom side thereof for holding the spreader. The two bolts are respectively inserted through the support member and the locking block to combine the support and the locking block together. One of the two bolts is inserted through a locating hole of the spreader to secure the spreader to the mounting groove of the locking block. When the user intends to remove the quick release device from the spreader, the user must push the locking block leftwards to force the bolt to disengage from the locating hole of the spreader, thus removing the quick release device from the spreader.

According to the '715 publication, a control member is provided for pulling by the user to move the bolt away from the locating hole of the spreader for allowing removal of the quick release device from the spreader.

The aforesaid two designs allow mounting or dismounting the quick release device on or from the spreader. However, both of the two designs are structurally complicated. Further, mounting and dismounting of the two designs requires additional time, thus causing operational inconvenience to the user.

SUMMARY

The present disclosure provides a quick release device, which allows quick mounting thereof on and dismounting thereof from the spreader of a saw blade guard assembly in a circular saw, which has a simple structure and avoids the issues discussed above.

The quick release device is composed of a mounting block, at least one movable engagement member, and a locking member. The mounting block comprises two spaced sidewalls, a mounting groove defined between the two sidewalls for receiving the spreader, and at least one through hole cut through one of the sidewalls and in communication with the mounting groove and a locating hole of the spreader respectively. The movable engagement member is movably disposed in the through hole of the mounting block. The locking member includes two spaced locking blocks for connection with the sidewalls of the mounting block, whereby the mounting block is located between the two locking blocks of the locking member. Each of the locking blocks has a retaining wall portion for selective engagement with the movable engagement member and forcing the movable engagement member into the locating hole of the spreader.

Based on the aforesaid design, the quick release device has a simple structure. When the retaining wall portions of the locking blocks of the locking member do not contact against the movable members, the quick release device can then be removed from the spreader. Therefore, the quick release device of the present disclosure is convenient in operation, and thus facilitates the convenient operation of the circular saw.

DETAILED DESCRIPTION OF VARIOUS EMBODIMENTS

Figure 1:
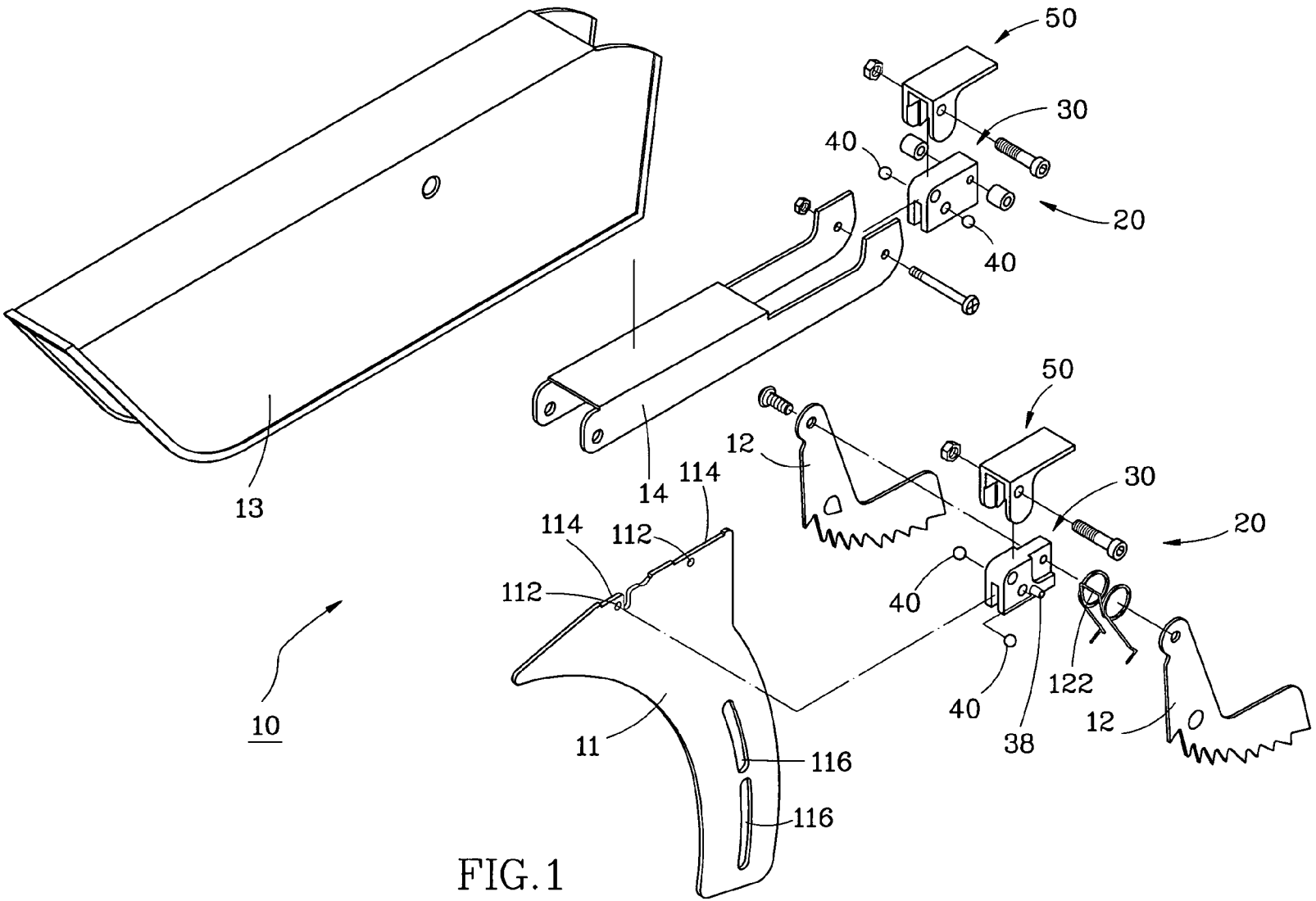
FIG. 1 is an exploded view of two quick release devices mounted to a saw blade guard assembly in a circular saw in accordance with a first embodiment of the present disclosure.
Figure 2:
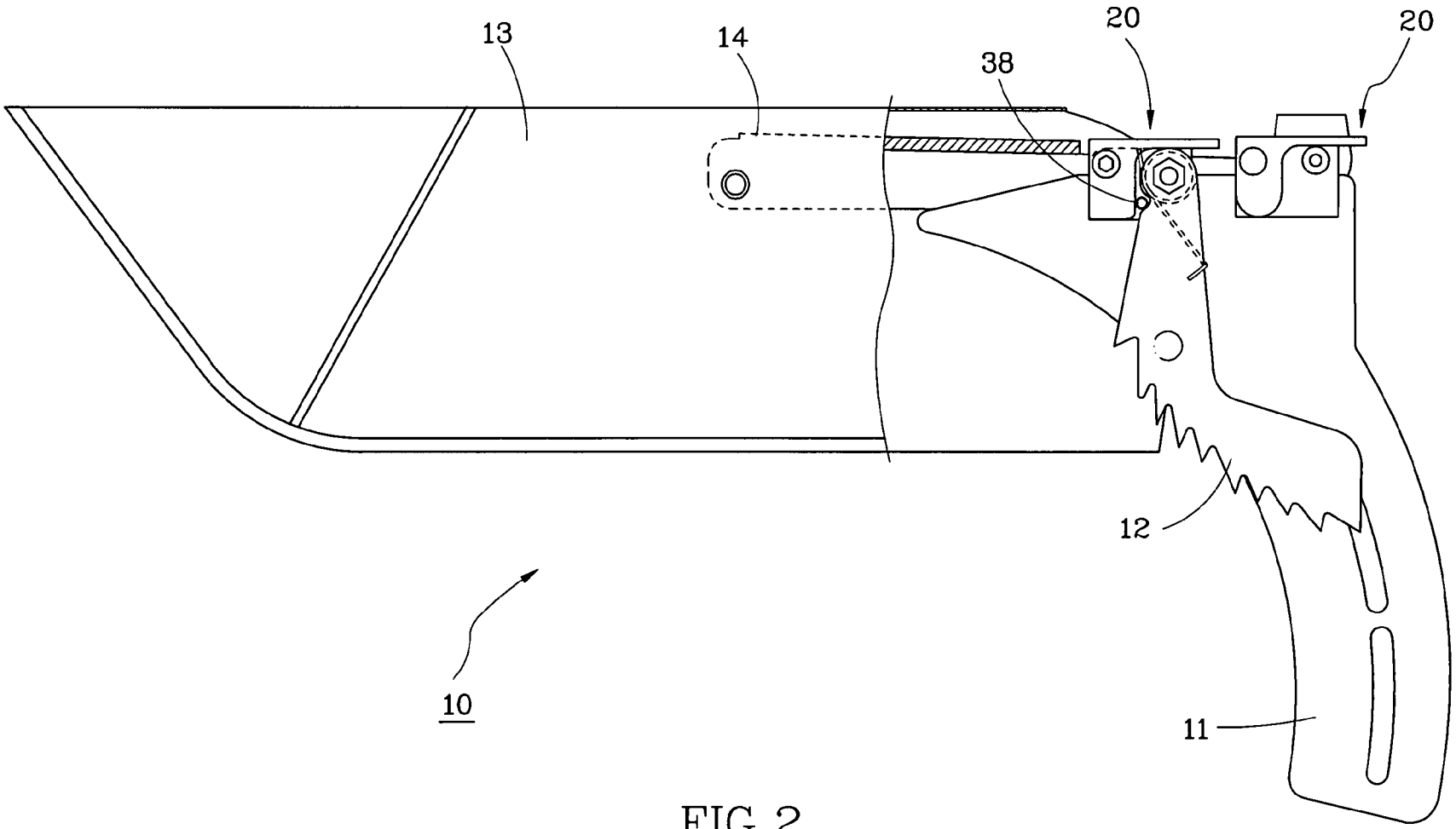
FIG. 2 is a schematic plain view of the two quick release devices mounted to the saw blade guard assembly in the circular saw in accordance with the first embodiment of the present disclosure.

Referring to FIGS. 1 and 2, two quick release devices 20 in accordance with a first embodiment of the present disclosure are mounted to a saw blade guard assembly 10 in a circular saw (not shown). The saw blade guard assembly 10 is composed of a spreader 11, an antikickback device 12, and a guard cover 13.

The spreader 11 has two locating holes 112 positioned at a top edge thereof and spaced from each other by a predetermined distance. Two top notches 114 are located close to the locating holes 112, and two elongated slots 116 are arranged at different elevations thereof. The spreader 11 can be connected with a saw blade holder (not shown) via connecting means (not shown) mounted to the two elongated slots 116, thus being movable up and down along with the saw blade to prevent a cut part of a workpiece (not shown) from incorrect engagement during the cutting operation of the saw blade.

Figure 3:
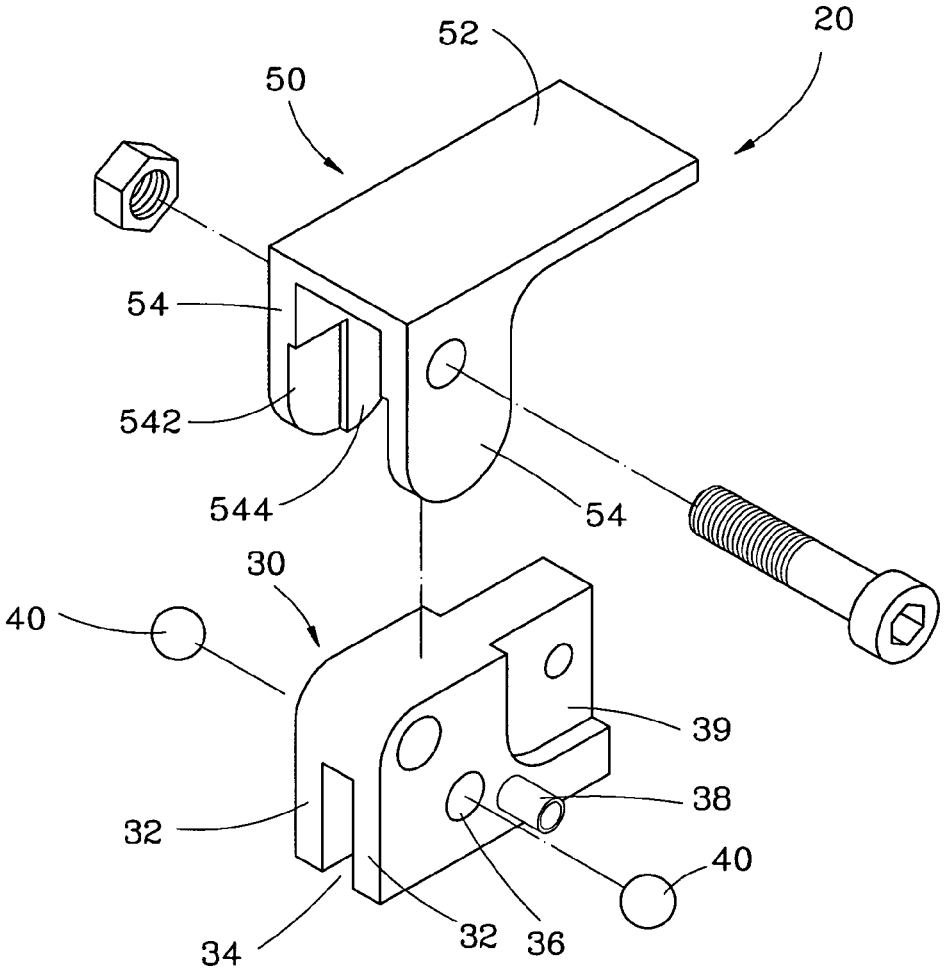
FIG. 3 is an exploded view of a quick release device in accordance with the first embodiment of the present disclosure.

Referring to FIG. 3, each of the quick release devices 20 is composed of a mounting block 30, two movable engagement members 40, and a locking member 50.

The mounting block 30 includes two sidewalls 32 spaced from each other by a predetermined distance, a mounting groove 34 defined between the sidewalls 32 for receiving the spreader 11, and two associated through holes 36 respectively cut through the sidewalls 32 and in communication with the mounting groove 34 and the locating holes 112 of the spreader 11. The mounting block 30 of one of the two quick release devices 20 further includes two stop rods 38 respectively extending from the sidewalls 32, and two recessed portions 39 respectively formed on the sidewalls 32. The length of each of the sidewalls 32 of the mounting blocks 30 of the two quick release devices 20 is a little smaller than that of the top notch 114 of the spreader 11 so that the mounting blocks 30 can quickly be coupled to the top notches 114 to keep the respective through holes 36 in alignment with the mounting holes 112 of the spreader 11.

The movable engagement member 40 according to this embodiment is formed as steel balls mounted in the through hole 36 of the associated mounting block 30 and freely movable in the associated through hole 36. The movable engagement members 40 each have a diameter larger than the thickness of the sidewall 32 so that the movable engagement members 40 are partially exposed out of the through holes 36.

Figure 4:
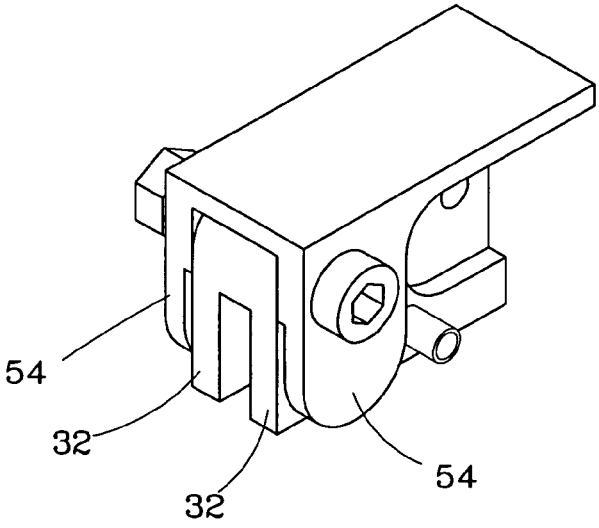
FIG. 4 is a perspective view of the quick release device in accordance with the first embodiment of the present disclosure.
Figure 5:
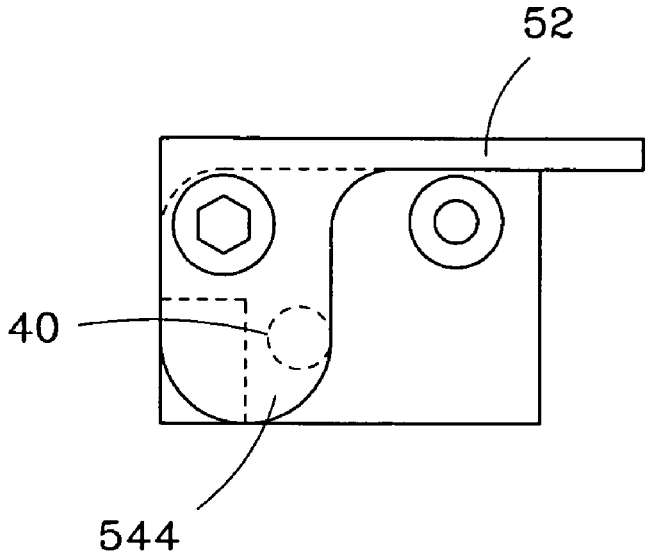
FIG. 5 is a schematic side view of a quick release device according to the first embodiment of the present disclosure, showing that the quick release device is locked.
Figure 7:
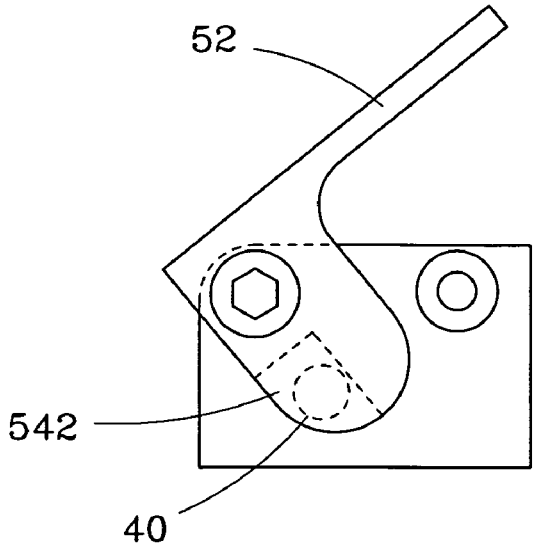
FIG. 7 is a schematic side view of a quick release device according to the first embodiment of the present disclosure, showing that the quick release device is unlocked.
Figure 8:
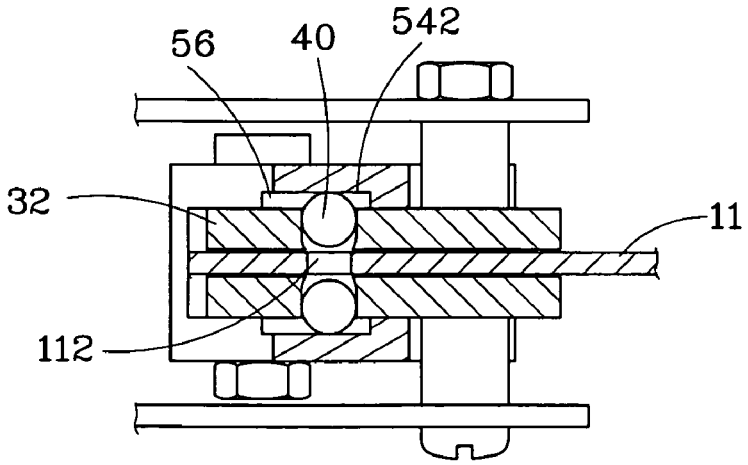
FIG. 8 is a bottom view of FIG. 7, showing that the retaining wall portions are disengaged from the associated movable engagement members.

The locking member 50 includes a handle 52 and two locking blocks 54 extending downward from two sides of one end of the handle 52 respectively. The two locking blocks 54 are spaced from each other by a predetermined distance and are pivotally coupled to the two sidewalls 32 of the mounting block 30, as shown in FIG. 4. The locking blocks 54 each have a recessed wall portion 542 formed on an inner side thereof, and a retaining wall portion 544 formed on the inner side and abutting the recessed wall portion 542. The distance between the recessed wall portion 542 and the associating sidewall 32 of the mounting block 30 is larger than the distance between the retaining wall portion 544 and the associated side wall 32 of the mounting block 30. Therefore, a gap 56 is formed between the recessed wall portion 542 and the associated sidewall 32 of the mounting block 30. When the locking member 50 is moved relative to the mounting block 30 to the position where the recessed wall portions 542 face the movable engagement members 40, the gaps 56 provide space for free rolling of the movable engagement members 40, as shown in FIGS. 7 and 8. When the locking member 50 is moved relative to the mounting block 30 to the position where the retaining wall portions 544 face the movable engagement members 40, the retaining wall portions 544 force the movable engagement members 40 to approach each other and then into engagement with the locating holes 112 of the spreader 11, as shown in FIGS. 5 and 6.

The antikickback device 12 is respectively pivotally connected to the two recessed portions 39 of the mounting block 30 of the quick release device 20 via a torsion spring 122, for preventing the workpiece from sudden kickback during the cutting process. The antikickback device 12 can be stopped by the stop rods 38 of the mounting block 30 to avoid any excessively forward pivoting movement forced by the torsion spring 122.

Figure 6:
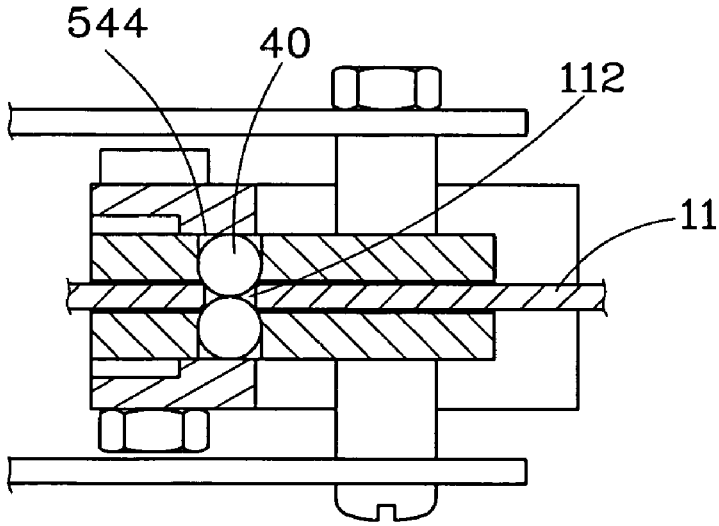
FIG. 6 is a bottom view of FIG. 5, showing that the retaining wall portions are respectively engaged with the associated movable engagement members.

As shown in FIGS. 1 and 6, guard cover 13 is pivotally connected at a connecting hole (unlabeled) to the mounting block 30 of the other quick release device 20 by means of a link 14. The link 14 includes a two flanges having connecting through holes (unlabeled) and a pivot rod (unlabeled) passes therethrough and through the connecting hole of the mounting block 30. Therefore, the guard cover 13 can pivot relative to the spreader 11.

When the user intends to remove the antikickback device 12 and the guard cover 13 from the spreader 11, the user can force the handle 52 of the respective locking member 50 to turn the locking member 50 upward to enable the recessed wall portions 542 to face the movable engagement members 40 respectively, as shown in FIG. 7, allowing the movable engagement members 40 to move away from the respective locating holes 112 toward the respective gaps 56, as shown in FIG. 8. Therefore, the mounting blocks 30 of the quick release devices 20 are unlocked from the spreader 11 for allowing removal of the antikickback device 12 and the guard cover 13 from the spreader 11 via the quick release devices 20.

On the other hand, when the user intends to mount the antikickback device 12 and the guard cover 13 onto the spreader 11, the user can install the mounting blocks 30 of the quick release devices 20 onto the top notches 114 of the spreader 11 via the mounting grooves 34 to enable alignment of the movable engagement members 40 with the locating holes 112 of the spreader 11 respectively. The user can then operate the handles 52 of the locking members 50 to turn the locking members 50 downward to enable the retaining wall portions 544 to stop against the movable engagement members 40 and to force the movable engagement members 40 to approach each other and into engagement with the locating holes 112 of the spreader 11 respectively, as shown in FIGS. 5 and 6. Therefore, the mounting blocks 30 are locked to the spreader 11, and the antikickback device 12 and the guard cover 13 are firmly secured to the spreader 11 via the quick release devices 20.

Figure 9:
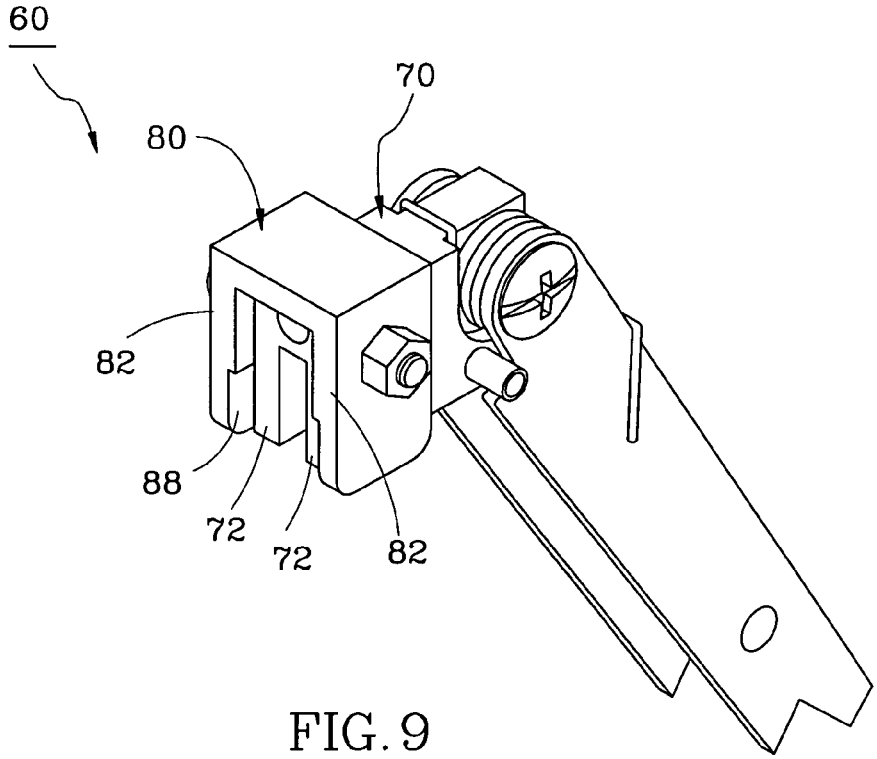
FIG. 9 is a perspective view of a quick release device in accordance with a second embodiment of the present disclosure.

Referring to FIG. 9, a quick release device 60 in accordance with a second embodiment of the present disclosure is shown. This embodiment is substantially similar to the aforesaid first embodiment and differs in that the sidewalls 72 of the mounting block 70 of this second embodiment each have a sliding slot 74, and two locking blocks 82 of the locking member 80 of this second embodiment are coupled to the sliding slots 74 of the sidewalls 72 of the mounting block 70 via a pin 84, allowing the locking member 80 to move relative to the mounting block 70 in such a way that the pin 84 is moved between first and second ends of each of the sliding slots 74.

Figure 10:
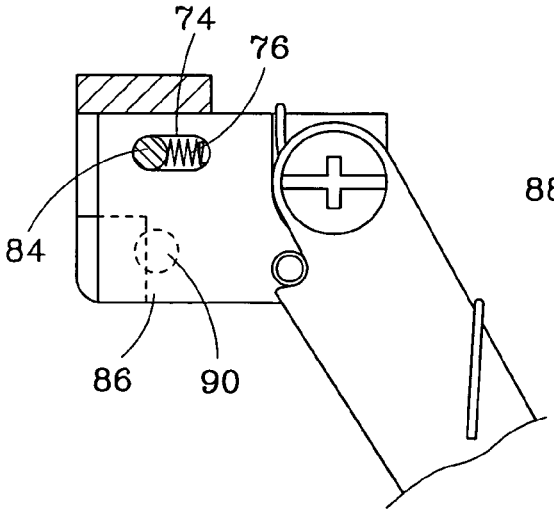
FIG. 10 is a schematic sectional view of the second embodiment of the present disclosure, showing a pin stopped at the front ends of sliding slots.
Figure 11:
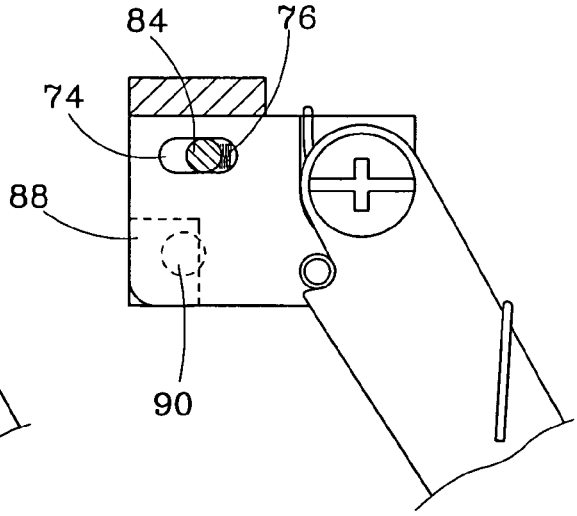
FIG. 11 is a schematic sectional view of the second embodiment of the present disclosure, showing the pin stopped at the rear ends of the sliding slots.

When the pin 84 is stopped at the first or front ends of the sliding slots 74, as shown in FIG. 10, the retaining wall portions 86 of the locking blocks 82 of the locking member 80 are stopped against the movable engagement members 90 to force the movable engagement members 90 to move toward each other. When the locking member 80 is pulled backward to move the pin 84 to be stopped at the second or rear ends of the sliding slots 74, as shown in FIG. 11, the retaining wall portions 86 of the locking blocks 82 of the locking member 80 are released from the movable engagement members 90, and the recessed wall portions 88 of the locking member 80 face the movable engagement members 90 to allow free rolling of the movable engagement members 90. Further, a spring member 76 is installed in the mounting block 70 to bias the pin 84 towards the front ends of the sliding slots 74.

As stated above, the quick release device of the present disclosure has a simple structural design. By means of cooperation between the mounting block and the locking member, the quick release device can be quickly mounted to the spreader or removed from the spreader to provide a more convenient operation.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A quick release device for a saw blade guard assembly mounted to a circular saw, said saw blade guard assembly having a spreader including a locating hole, said quick release device comprising:

a mounting block having first and second spaced sidewalls, a mounting groove formed between said first and second sidewalls for receiving said spreader, and a through hole defined through one of said first and second sidewalls of said mounting block and in communication with said mounting groove and said locating hole of said spreader;

at least one movable engagement member movably disposed in said through hole of said mounting block; and a locking member having a locking block proximate to said sidewall having said through hole, said locking block having a retaining wall portion configured for engaging said movable engagement member and forcing said movable engagement member into the locating hole of said spreader;

wherein said locking block further comprises a recessed wall portion spaced from said mounting block at a distance larger than a distance between said retaining wall portion and said mounting block wherein said recessed wall portion and said retaining wall portion selectively face said movable engagement member; said movable engagement member configured to move in said through hole when said recessed wall portion faces said movable engagement member; said retaining wall portion stopping against the movable engagement member in an axial direction of the through hole of the mounting block when said retaining wall portion faces said movable engagement member.

2. The quick release device according to claim 1, wherein said movable engagement member has a diameter larger than a thickness of the associated first or second sidewall of said mounting block.

3. The quick release device according to claim 1, wherein said locking block is pivotally connected to the associated first or second sidewall of said mounting block.

4. The quick release device according to claim 1, wherein said locking block is slidably arranged proximate to the associated first or second sidewall of said mounting block.

5. The quick release device according to claim 4, wherein one of said first and second sidewalls of said mounting block comprises a sliding slot, and a pin mounted in said sliding slot to allow said locking member to slidably move relative to said mounting block.

6. The quick release device according to claim 5, wherein said mounting block further comprises a spring member abutting said pin to maintain said pin in a predetermined position within said sliding slot.

7. The quick release device according to claim 1, wherein said locking member further comprises a handle connected to said locking block.

8. A quick release device for a saw blade guard assembly mounted to a circular saw, said saw blade guard assembly comprising a spreader having a locating hole, the quick release device comprising:

a mounting block having first and second spaced sidewalls, a mounting groove defined between said first and second sidewalls for receiving said spreader, and first and second through holes respectively defined through said first and second sidewalls and in communication with said mounting groove and said locating hole of said spreader;

first and second movable engagement members respectively movably disposed in the first and second through holes of said mounting block; and a locking member having first and second locking blocks respectively proximate to the first and second sidewalls of said mounting block, said first and second locking blocks each having a retaining wall portion configured for respectively engaging said first and second movable engagement members and forcing and holding said first and second movable engagement members within the locating hole of said spreader;

wherein said first and second locking blocks each further comprise a recessed wall portion spaced from said mounting block at a distance greater than a distance between the retaining wall portions and said mounting block;

wherein said recessed wall portions and said retaining wall portions selectively face said movable engagement members; said movable engagement members configured to move in said first and second through holes when said recessed wall portions face said movable engagement members: said retaining wall portions stopping against the moveable engagement members in an axial direction of said first and second through holes of the mounting block when said retaining wall portions face said movable engagement members.

9. A saw blade guard assembly for a circular saw, comprising:

a spreader having at least one locating hole;

a quick release device having:

a mounting block mounted to said spreader and having first and second spaced sidewalls, a mounting groove defined between said first and second sidewalls for receiving said spreader, and first and second through holes defined through said first and second sidewalls respectively, said first and second through holes corresponding to each other and in communication with said mounting groove and said locating hole of said spreader;

at least one movable engagement member movably disposed in the first or second through hole of said mounting block;

a locking member having first and second spaced locking blocks respectively coupled to the first and second sidewalls of said mounting block to maintain said mounting block between said first and second locking blocks, said first and second locking blocks each having a retaining wall portion configured for engaging and holding said at least one movable engagement member within the locating hole of said spreader; and a guard cover pivotally connected to a first end of said mounting block.

10. The saw blade guard assembly according to claim 9, wherein the at least one movable engagement member includes first and second movable engagement members respectively movably mounted in the first and second through holes of said first and second sidewalls of said mounting block, and configured for selective engagement by the retaining wall portions of the first and second locking blocks of said locking member for movement toward each other and into engagement with the locating hole of said spreader.

11. The saw blade guard assembly according to claim 9, wherein said first and second locking blocks of said locking member each further comprise a recessed wall portion abutting the respective retaining wall portion and spaced from said mounting block at a distance larger than a distance between the retaining wall portion of said locking member and said mounting block; said at least one movable engagement member configured to move in said first or second through holes when said recessed wall portions face said at least one movable engagement member.

12. The saw blade guard assembly according to claim 9, wherein the at least one movable member has a diameter larger than a thickness of the associated first or second sidewall of said mounting block.

13. The saw blade guard assembly according to claim 9, wherein said first and second locking blocks of said locking member are respectively pivotally connected to the first and second sidewalls of said mounting block.

14. The saw blade guard assembly according to claim 9, wherein said locking blocks of said locking member are respectively slidably mounted to the first and second sidewalls of said mounting block.

15. The saw blade guard assembly according to claim 9, wherein said locking member further comprises a handle connected to said first and second locking blocks.

16. A saw blade guard assembly for a circular saw, comprising:

a spreader having at least one locating hole;

a quick release device having;

a mounting block mounted on said spreader, said mounting block having first and second spaced sidewalls, a mounting groove defined between said first and second sidewalls for receiving said spreader, and first and second through holes defined through said first and second sidewalls respectively and corresponding to each other, each of said first and second through holes in communication with said mounting groove and said locating hole of said spreader;

at least one movable engagement member movably disposed in the first or second through hole of said mounting block;

a locking member having first and second spaced locking blocks respectively coupled to the first and second sidewalls of said mounting block to maintain said mounting block between said first and second locking blocks, said first and second locking blocks each having a retaining wall portion configured for engaging and forcing said at least one movable engagement member within the locating hole of the spreader; and an antikickback device pivotally connected to a first end of said mounting block.

17. The saw blade guard assembly according to claim 16, wherein the at least one movable engagement member includes first and second movable engagement members movably mounted respectively in the first and second through holes of said first and second sidewalls of said mounting block and configured for selective engagement by the retaining wall portions of the first and second locking blocks of said locking member for movement toward each other to maintain said first and second movable engagement members within the locating hole of said spreader.

18. The saw blade guard assembly according to claim 16, wherein said first and second locking blocks of said locking member each further comprise a recessed wall portion spaced from said mounting block at a distance larger than a distance between the retaining wall portion of said locking member and said mounting block; said at least one movable engagement member configured to move in said first or second through holes when said recessed wall portions face said at least one movable engagement member.

* * * * *